US005944551A

United States Patent [19]

Kline et al.

[11] Patent Number: 5,944,551

[45] Date of Patent: Aug. 31, 1999

[54] ELECTRICAL CONNECTOR

[75] Inventors: Richard Scott Kline, Harrisburg; John Thomas Larkin, Jr., New Cumberland, both of Pa.

[73] Assignee: The Whitaker Corporation, Wilmington, Del.

[21] Appl. No.: 08/993,467

[22] Filed: Dec. 18, 1997

[51] Int. Cl.[6] ..... H01R 4/24

[52] U.S. Cl. ..... 439/418; 439/810

[58] Field of Search ..... 439/395–404, 439/411, 412, 417, 418, 801, 810

[56] References Cited

U.S. PATENT DOCUMENTS

| | | | |
|---|---|---|---|
| 4,183,607 | 1/1980 | Hughes . | |
| 5,137,476 | 8/1992 | Noble | 439/297 |
| 5,533,913 | 7/1996 | Bochm et al. | 439/810 |

*Primary Examiner*—Khiem Nguyen
*Attorney, Agent, or Firm*—Katherine A. Nelson

[57] ABSTRACT

An electrical connector generally comprising a housing, a terminal member and a clamping member. The housing has a first open end, a generally closed second end including a conductor passage, and an internal cavity extending between the ends. The terminal member has a first end which includes an IDC mating contact, a second end which includes a planar electrical contact, and a middle portion extending therebetween. The terminal member is positioned in the housing with the first end adjacent the first housing open end and the middle portion extending through the housing cavity. The second end is positioned within the clamping means conductor receiving area. A conductor is connected to the second end of the terminal member by passing it through the conductor passage into the conductor receiving area and actuating the clamping member which moves the planar electrical contact into contact with the conductor.

13 Claims, 8 Drawing Sheets

ELECTRICAL CONNECTOR

BACKGROUND OF THE INVENTION

1. Field of the Invention

This invention relates to electrical connecting means. More particularly, the invention relates to a connector block having different terminals at each end thereof.

2. Description of the Prior Art

It is now common practice in the electrical industry to establish electrical contact with coil wires of the type having various insulating coatings by providing an insulation displacement contact (IDC). An IDC terminal generally has a wire-receiving slot that receives the wire, penetrates any insulation on the wire, and establishes electrical contact with the conductor.

U.S. Pat. No. 4,183,607, which is incorporated herein by reference, describes an exemplary IDC. This IDC is described below with reference to FIGS. 1–4. As shown in FIG. 1, the IDC provides electrical connection between the ends of coil wires 4 and respective contacts 2. The coil 6 is wound on a bobbin 8 having parallel flanges 10, 12 and a terminal housing block 14 is formed integral with upper flange 12. A pair of terminal housings 16 are formed in the housing block 14. Since the two housings 16 are identical, only one will be described below.

Referring to FIGS. 1 and 2, housing 16 has a terminal-receiving face 18 which extends normally of the upper surface of flange 12 and a terminal-receiving cavity 20 extending inwardly from the terminal-receiving face 18. The housing 16 has a front external sidewall 22 which is spaced from the surface of flange 12, a back sidewall 24 which is integral with the surface of flange 12, an endwall 26 which is the one end of the housing block 14 and an endwall 28 which is a common endwall for the housings 16.

With specific reference to FIG. 2, the cavity 20 has internal front and back sidewalls 30 and 32. The front sidewall 30 is proximate to the external sidewall 22 and the back sidewall 32 is proximate to external sidewall 24. Referring to FIGS. 3 and 4, cavity 20 has opposed internal endwalls 34, 36 which are proximate to the housing endwalls 26, 28 respectively. The internal walls of the cavity extend to the inner end of the cavity 38.

A rib 40 extends transversely across the cavity 20 and between the internal sidewalls 30, 32. The upper end 33 of rib 40 is spaced from the terminal-receiving surface 18 of the housing 16. A wire-supporting ledge 42 is provided on one side surface of the rib 40 between the upper end 33 of the rib 40 and the inner end 38 of the cavity 20.

Returning to FIG. 2, wire-admitting slot means 46, 54 are provided in the back sidewall 24 and front sidewall 22 respectively, and communicate with the cavity 20. When a wire is positioned in the slots 46, 54, it extends diagonally across the upper portion 44 of the rib 40 and is spaced from the ledge 42. The end of the wire is wound on a severable binding post 58 as shown in FIG. 1.

Referring to FIGS. 3 and 4, the contacts 2 generally comprises a stamped member having a flat, leading end which is dimensioned to be inserted into the cavity 20. A slot 64 extends into the terminal from this leading end 62. The entrance portions of the slot extend arcuately as shown at 66 to a portion which has a substantially uniform width and parallel edges 67. A narrow shoulder 68 may be provided adjacent to the slot 64, the width of the shoulder being slightly greater than the thickness of the insulating coating on the wire. When the contact 2 is inserted into cavity 20, the shoulders 68 penetrate the insulation and provide electrical contact with the wire 4. The terminal as shown has lances 90 to retain it in the housing after insertion.

Various other configurations of IDC terminals and housings are known. See U.S. Pat. No. 4,531,803 for an example thereof. While these prior art IDC connectors provide efficient connection with a fixed insulated wire, the connectors generally overlook the connection of a lead wire to the free end of the terminal. The two patents referenced above suggest that the lead wire be provided with an additional connector, soldered to the terminal, or wrapped on the terminal. However, it is often necessary to reconfigure the lead wire assembly and if the lead wire is permanently fixed to the IDC contact, damage to the coil wires may result during reconfiguration.

Accordingly, there is a need for an electrical connector which provides an efficient and reliable connection between the IDC contacts and lead wires which is also removable.

SUMMARY OF THE INVENTION

The present invention relates to an electrical connector generally comprising a housing, a terminal member and a clamping means. The housing has first and second ends and an internal cavity extending between them. The first end is open and the second end is generally closed to define a conductor passage. The second end also includes a chamber which is aligned with and extends beyond the conductor passage. The terminal member has a first end which includes an IDC mating contact, a second end which includes a planar electrical contact, and a middle portion extending therebetween. The clamping means includes a conductor receiving area and is positioned in the chamber with the conductor receiving area aligned with the conductor passage. The terminal member is positioned in the housing with the first end adjacent the first housing open end and the middle portion extending through the housing cavity. The second end is positioned within the conductor receiving area. A conductor is connected to the second end of the terminal member by passing it through the conductor passage into the conductor receiving area and actuating the clamping means which moves the planar electrical contact into the conductor.

DETAILED DESCRIPTION OF THE PREFERRED EMBODIMENTS

Figure 1:
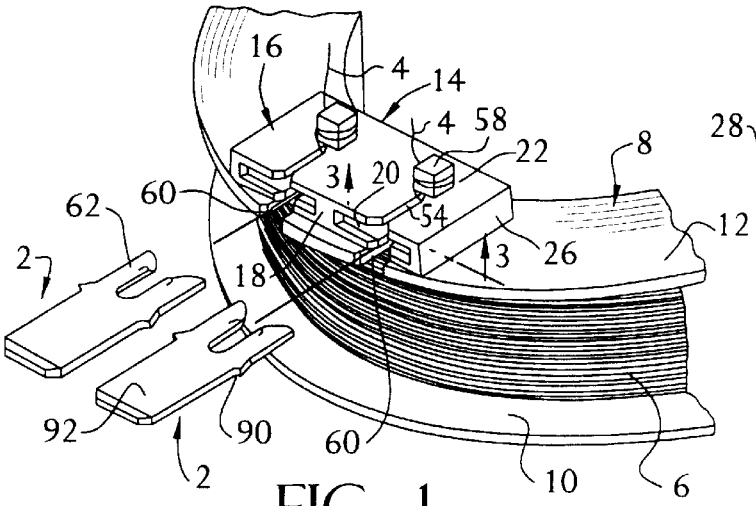
FIG. 1 PRIOR ART
FIG. 1 is a fragmentary perspective view of a prior art assembly showing a portion of a coil bobbin having an IDC housing mounted thereon and IDC terminals exploded from the housing.
Figure 3:
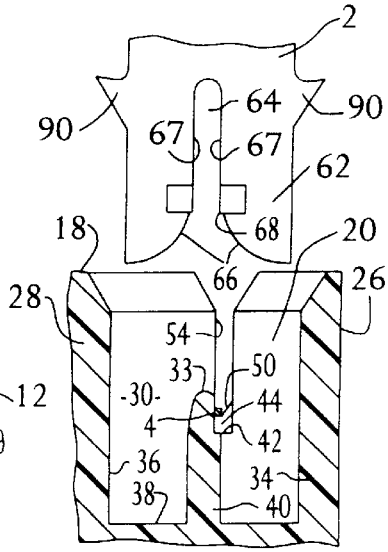
FIG. 3 PRIOR ART
FIG. 3 is a cross-sectional view of the prior art IDC housing of FIG. 1 looking in the direction of the arrow 3 of FIG. 1 and showing a prior art IDC terminal in alignment with the terminal-receiving cavity.
Figure 2:
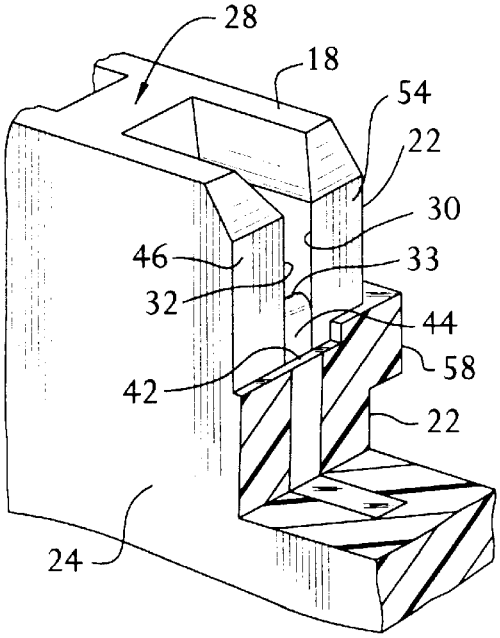
FIG. 2 PRIOR ART
FIG. 2 is a cut away fragmentary perspective view of a prior art IDC housing showing details of a terminal-receiving cavity.
Figure 4:
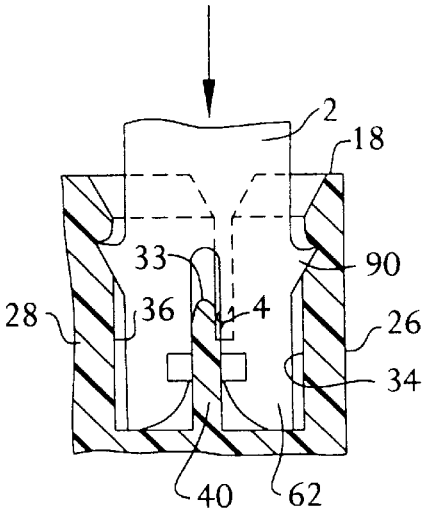
FIG. 4 PRIOR ART
FIG. 4 is similar to FIG. 3, but shows the prior art IDC terminal in its fully inserted position.

The preferred embodiment will be described with reference to the drawing figures where like numerals represent like elements throughout. Any reference to orientation herein is for clarity only and is not intended to limit the orientation of the device.

Figure 5:
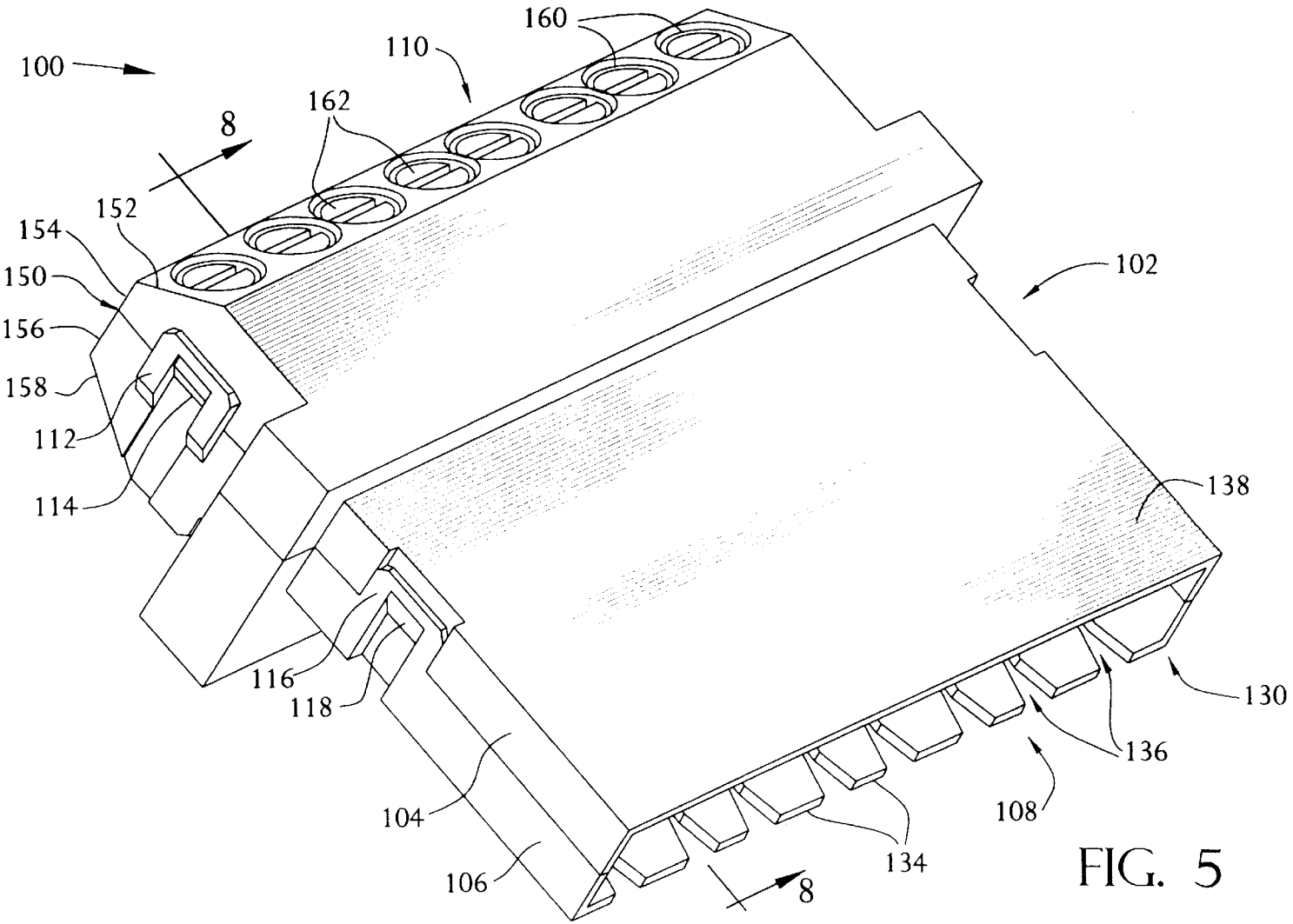
FIGS. 5 and 6 are isometric views of opposite sides of a connector made in accordance with the present invention.

Referring to FIGS. 5–8, a preferred embodiment of the connector 100 made in accordance with the present invention is shown. Referring specifically to FIG. 5, the connector 100 generally comprises a block housing 102, an IDC mating end 108, and a lead wire terminal end 110. The block housing 102 includes an upper cover 104 and a lower cover 106. The lateral edges of covers 104 and 106 are connected by latches 112 and 116 which extend from each side of lower cover member 106 and mate with tabs 114 and 118, respectively, extending from the sides of upper cover member 104. A plurality of posts 120, see FIG. 7, extend from the internal surface of lower cover 106 and corresponding receivers (not shown) extend from the internal surface of upper cover 104 to provide alignment of upper and lower covers for connection across the width of the housing 102. In the preferred embodiment, the posts 120 are round and the receivers have a hexagon opening, whereby an interference fit is established therebetween. The split housing 102 and quick fastening means allow the internal components of the connector 100 to be easily positioned inside the housing 102 and the connector 100 to be easily and efficiently assembled.

Figure 6:
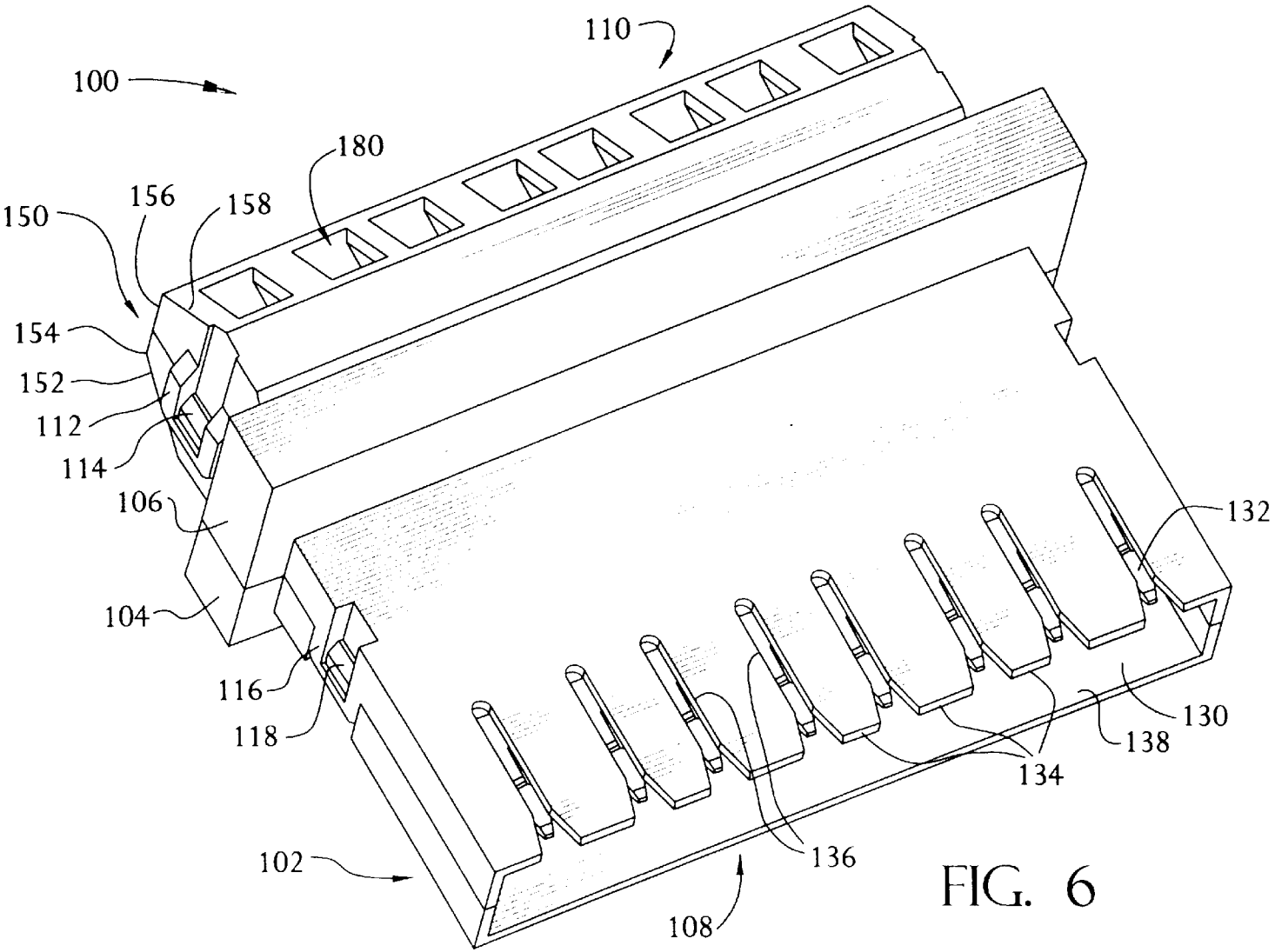
Figure 7:
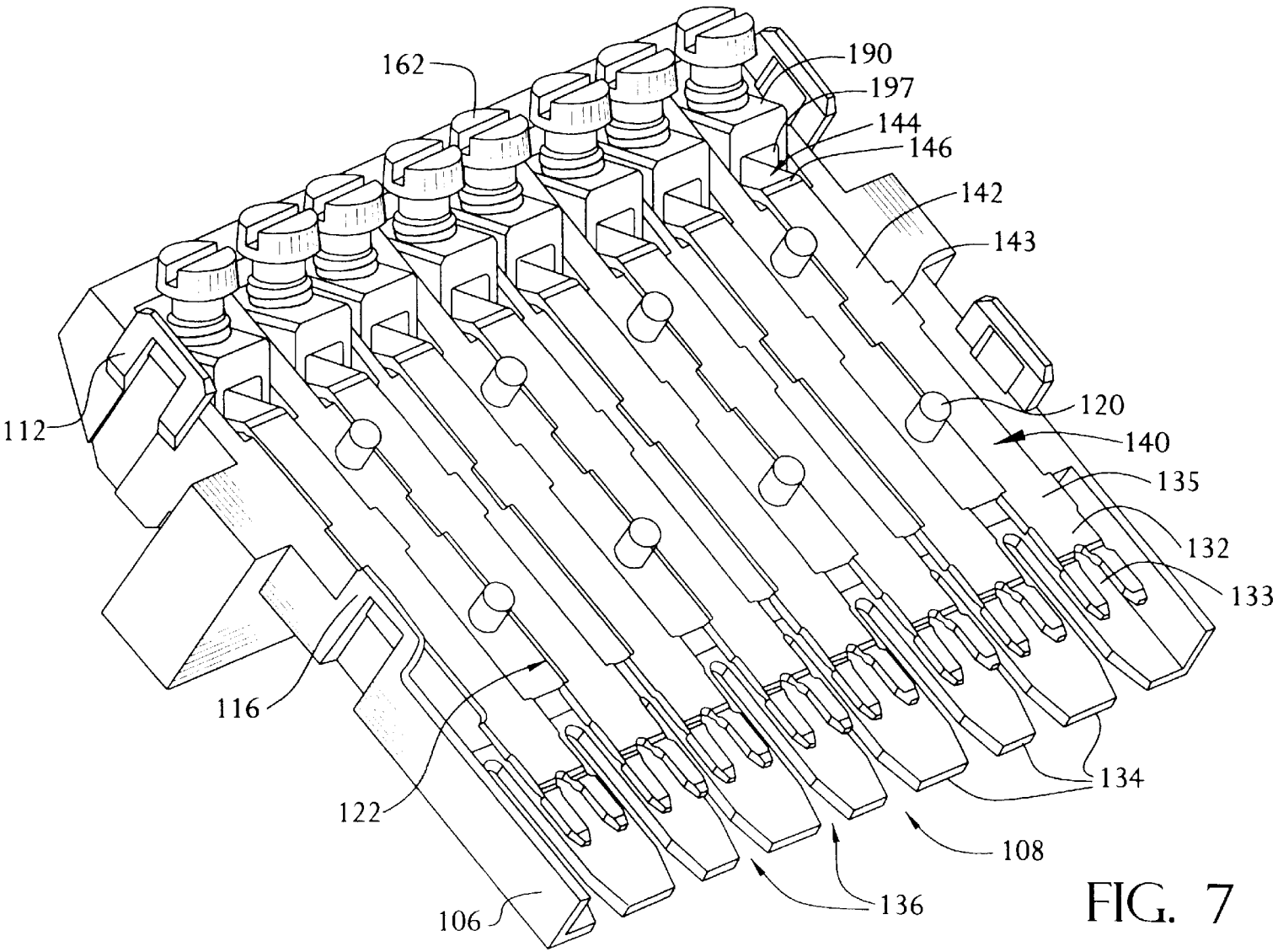
FIG. 7 is an isometric view of the connector of the present invention with one of the covers removed and the terminal screws left in the terminal clamps for description purposes only.
Figure 8:
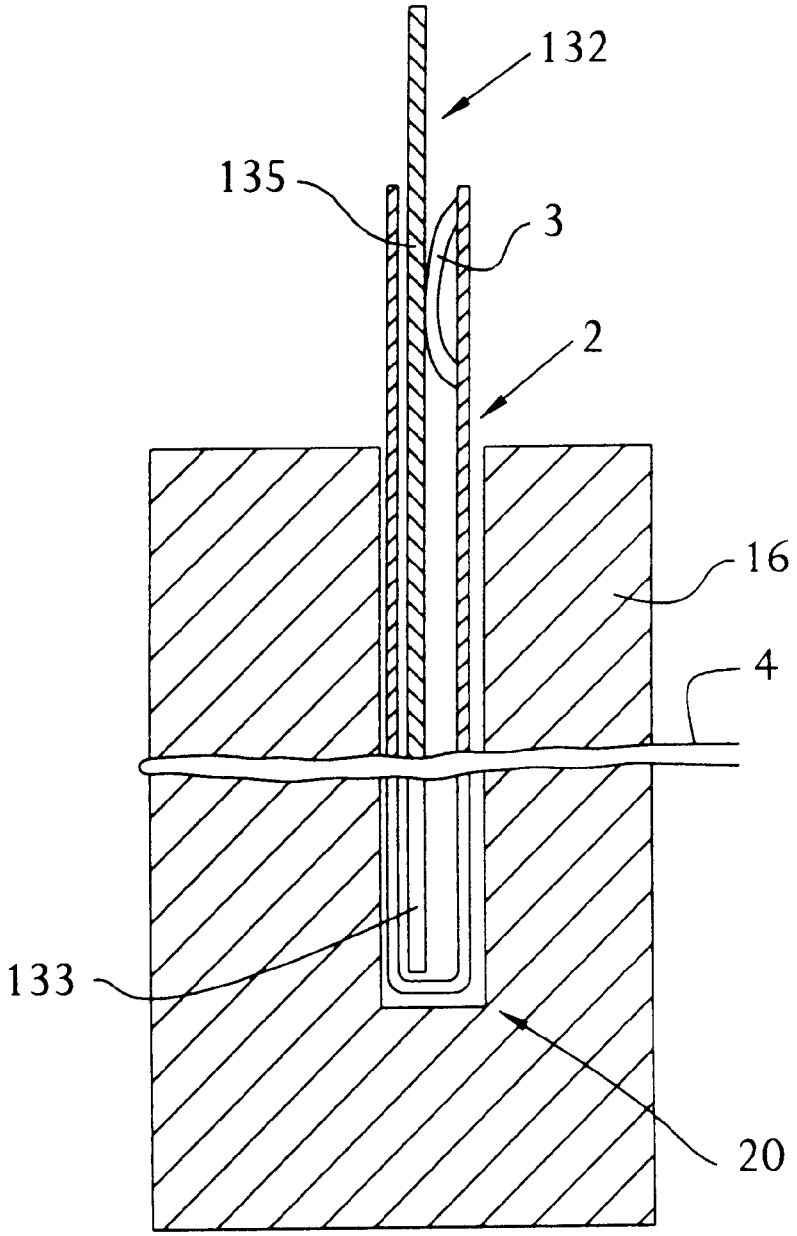
FIG. 8 is a sectional view showing the interconnection of an IDC mating terminal and an IDC contact.

As shown in FIGS. 6–9, the IDC mating end 108 of the connector 100 provides a number of IDC mating terminals 132 for contact with an IDC contact 2 (not shown). Although the preferred embodiment shows eight IDC mating terminals 132, any number of IDC mating terminals 132 can be provided, depending upon the application. The upper and lower cover members 104, 106 define an opening 130 at the IDC mating end 108 of the connector 100 which is dimensioned to receive an IDC terminal housing block 14, whereby the IDC mating terminals 132 can contact the IDC contacts 2. In the preferred embodiment, the IDC contacts are provided with resilient contacting means 3 which establish contact with and maintain the IDC mating terminals 132 positioned as shown in FIG. 8. The front slot 133 in each IDC mating terminal 132 allows the mating terminal 132 to fully enter the terminal block cavity 20 so that the resilient contact means 3 contact a planar portion 135 of the mating terminal 132. The specific configuration of the IDC mating terminals 132 and the IDC contacts 2 may be adapted to meet a given application. In particular, the IDC mating terminals 132 may be provided with the resilient contacting means and the IDC contacts 52 may be planar.

Referring to FIG. 6, which shows the connector 100 from the side opposite of that shown in FIG. 5, the lower cover member 106 includes a plurality of ribs 134 separated by wire slots 136. Each wire slot 136 is aligned with a respective terminal 132 to permit each wire 4 to pass into the housing 102 as the IDC terminal housing block 14 is engaged with the connector 100.

Figure 14:
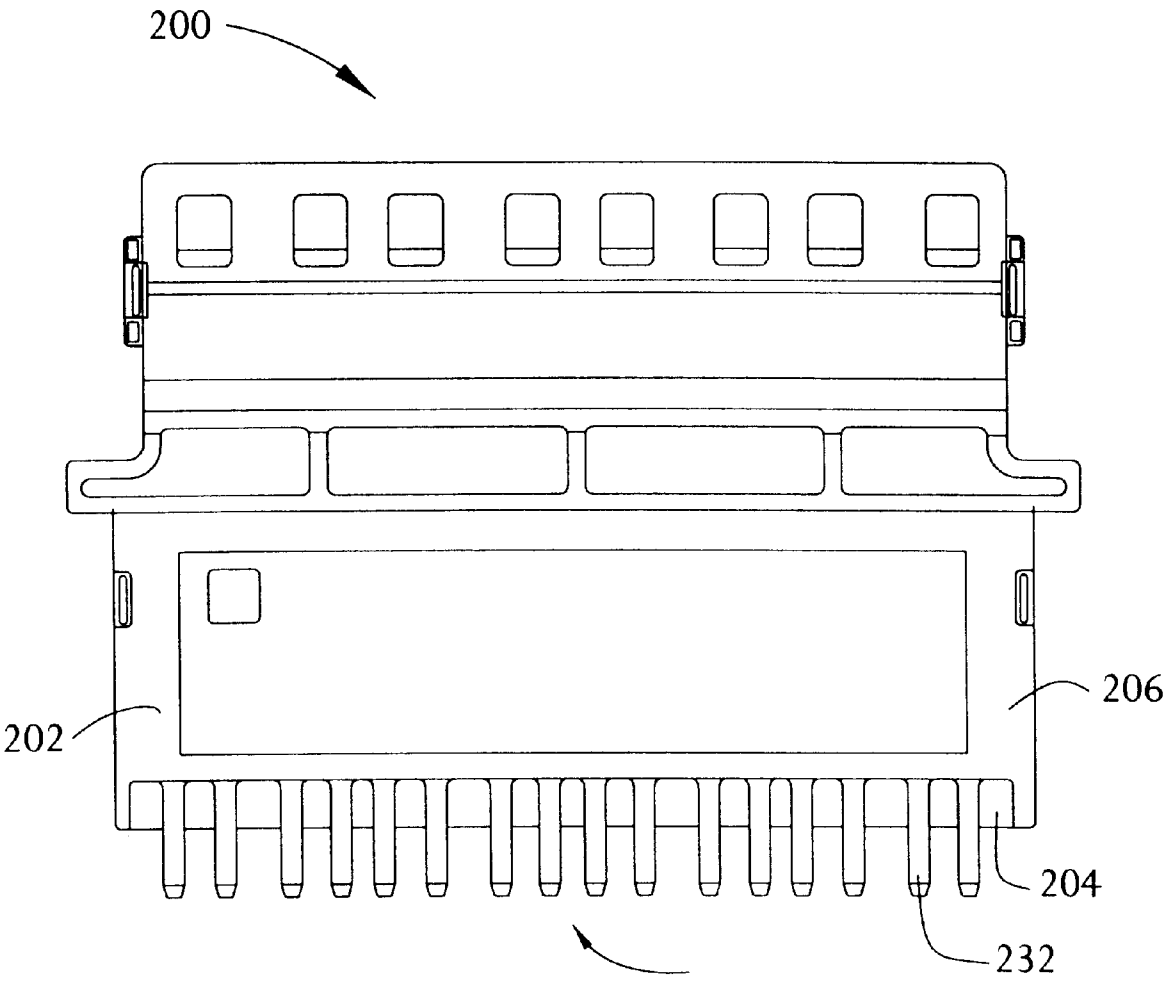
FIG. 14 is a top plan view of an alternate embodiment of the connector in accordance with the present invention.

In the alternative embodiment shown in FIG. 14, the upper and lower cover members 204 and 206 are shortened at the IDC terminal end 208 of the connector 200 to allow IDC terminals 232 to extend beyond the plane of the housing 202. This allows IDC mating terminals 232 to be inserted into the IDC terminal housing 16 without any interference from the connector housing 202.

Figure 9:
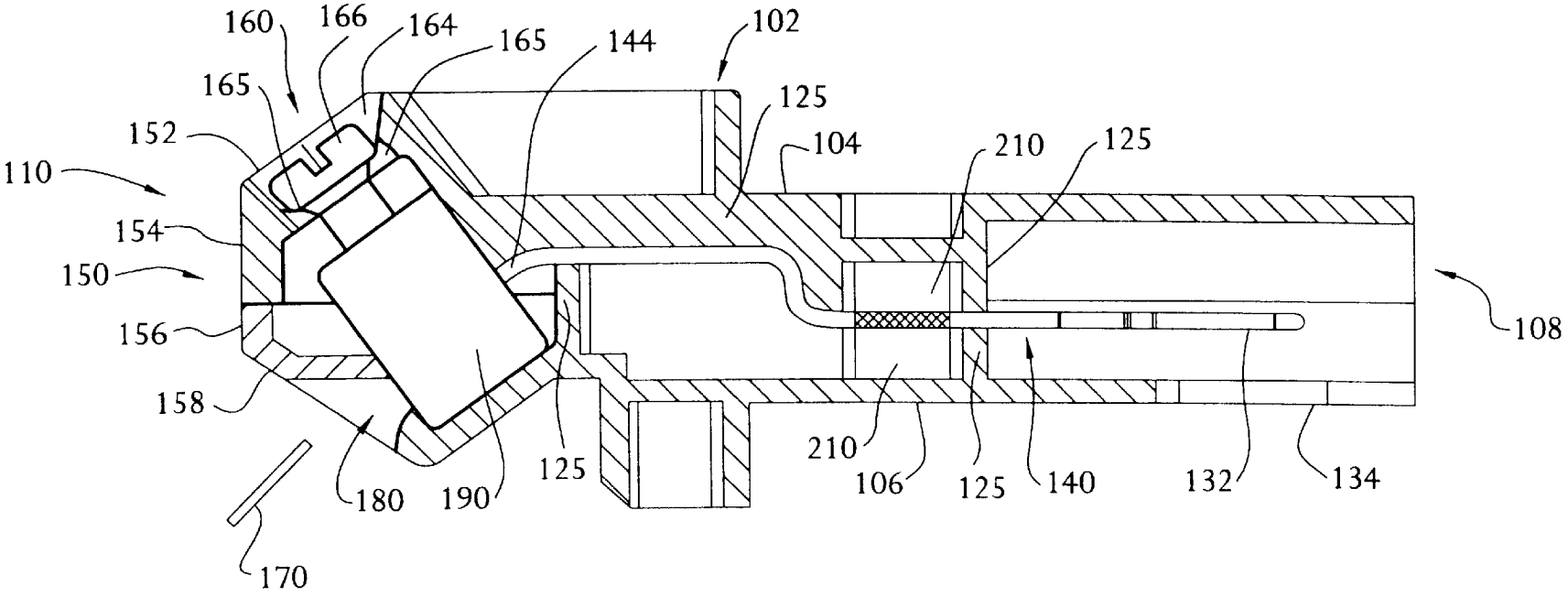
FIG. 9 is a sectional view taken along the line 9—9 in FIG. 1.
Figure 10:
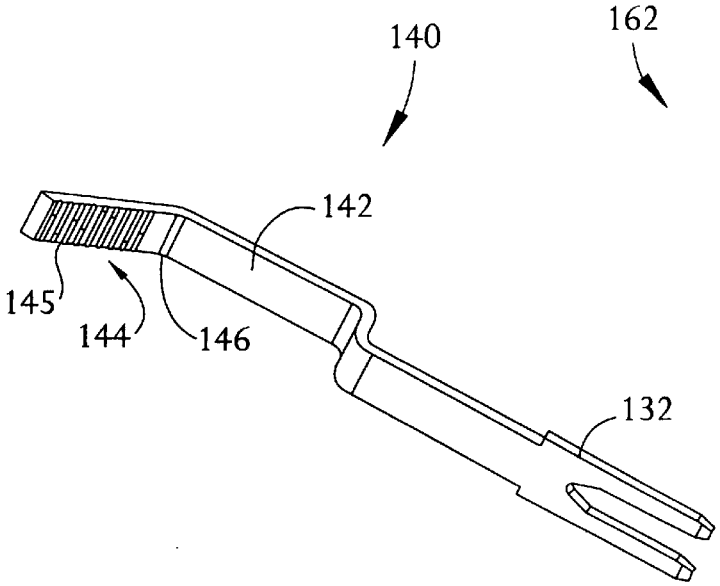
FIG. 10 is an isometric view of a terminal body in accordance with the present invention.

Referring to FIGS. 7 and 9–10, it can be seen that each IDC mating terminal 132 is an integral part of a terminal body 140 that extends along the substantial length of the connector 100. Each terminal body 140 includes an IDC mating terminal 132, a lead wire terminal 144 and an intermediate portion 142 connecting the terminals 132 and 144. As can be seen in FIGS. 7 and 9, the intermediate portion 142 may have various configurations depending on the specific configuration of the connector housing 102. In any event, the intermediate portion 142 serves to provide an electrical connection between terminals 132 and 144. A bend 146 is provided at the junction of intermediate portion 142 and lead wire terminal 144 to provide the proper orientation of lead wire terminal 144 as will be described in more detail hereinafter. A plurality of ridges 145 are provided along the inner surface of terminal 144 to maintain its connection to the lead wire 170.

In the preferred embodiment, the internal surfaces of cover members 104 and 106 have a plurality of opposed grooves 122 in which the terminal body intermediate portions 142 sit. When the cover members 104 and 106 are brought together, the terminal bodies 140 are thereby maintained in position. Shoulders 143 may be provided along the intermediate portions 142 to provide additional stability to the terminal bodies 140.

In an alternate embodiment, as shown in FIG. 9, the cover members 104 and 106 are provided with support structures 125 between which the terminal bodies 140 are maintained.

The lead wire terminal end 110 of the connector 100 will now be described with reference to FIGS. 9–13. Referring to FIG. 9, vertical end walls 154 and 156 of cover members 104 and 106, respectively, provide a closed end 150. Extending from each vertical end wall 154 and 156, is an angled surface 152 and 158, respectively. The lead wire connector assembly 160 is positioned in the connector housing 102 such that the lead wire clamp 190 extends generally parallel to the upper angled surface 152 and the lead wire 170 is inserted normal to the lower angled surface 158. As such, angled surfaces 152 and 158 are angled relative to one another such that the lead wire 170 can be positioned inside clamp 190 substantially parallel to the lower inner surface 198 thereof, as shown in FIG. 13.

Figure 11:
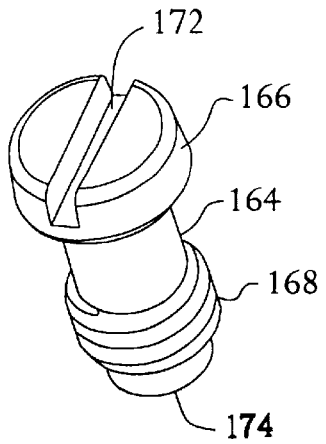
FIG. 11 is an isometric view of a terminal screw in accordance with the present invention.

Each lead wire terminal assembly 160 generally includes a terminal screw 162, a clamp 190, and a lead wire terminal 144. As shown in FIG. 11, the terminal screw 162 includes a head 166 and a shaft 164. Preferably a slot 172 is provided in the head to allow adjustment of the screw 162, however, any adjustment means can be provided in screw head 166. A contact surface 174 is provided at the end of shaft 164 opposite the head 166. A plurality of threads 168 extend from shaft 164. The number, size, and configuration of the threads can be adjusted to meet the needs of a particular application.

Figure 12:
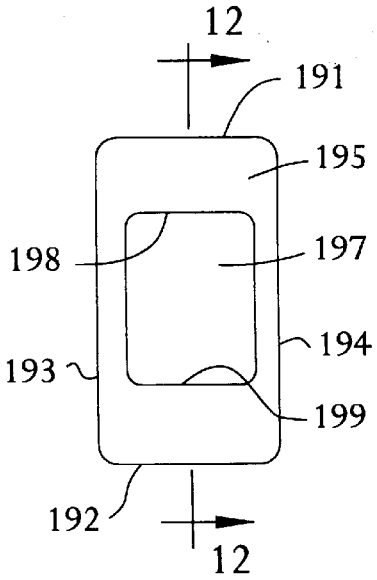
FIG. 12 is an elevation view of a terminal clamp in accordance with the present invention.
Figure 13:
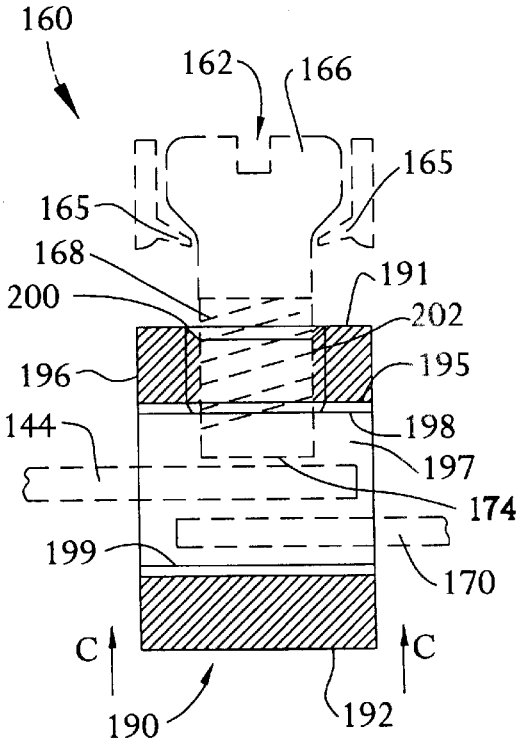
FIG. 13 is a sectional view taken along the line 13—13 in FIG. 12.

Referring to FIGS. 12 and 13, the clamp 190 generally comprises top and bottom surfaces 191 and 192, opposed lateral sides 193 and 194, and opposed front and rear faces 195 and 196. An aperture 197 passes through the clamp 190 from the front face 195 to the rear face 196. The aperture 197 defines internal top and bottom surfaces 198 and 199 which are generally parallel to clamp top and bottom surfaces 191 and 192. A screw receiving core 200 extends from the clamp top surface 191 to the internal top surface 199. The core 200 is provided with threads 202 which mate with screw threads 168 when the lead wire terminal assembly 160 is assembled.

Referring to FIGS. 5–7 and 9, assembly of the connector 100 will be described. A plurality of clamps 190 are positioned in the lower cover 106 such that each aperture 197 is aligned with a lead wire receiving opening 180 which extends through the lower angled surface 158. An equal number of terminal bodies 140 are positioned in the lower cover member 106 with each lead wire terminal 144 positioned in the aperture 197 of a respective clamp 190. The bend 146 of each terminal body 140 is such that the lead wire terminal 144 is positioned substantially parallel to the respective clamp internal bottom surface 199. Once the clamps 190 and terminal bodies 140 are in position, the upper cover member 104 is connected with the lower cover member 106. The latches 112 and 116 mate with the respective tabs 114 and 118 and the posts 120 mate with the respective top cover receivers in an interference fit. Although FIG. 7 shows the terminal screws 162 set in clamps 190 prior to application of the upper cover 104, the figure is for description only. In use, the terminal screws 162 are provided through screw receiving openings 164 in the angled surface 152 of the upper cover 104 after the cover members 104 and 106 are connected. As can be seen in FIG. 9, each screw receiving opening 164 has internal shoulders 165 upon which the screw head 166 abuts. The shoulders 165 prevent forward movement of the screw 162 upon rotation thereof, the function of which will be described hereinafter.

Referring to FIGS. 9 and 13, connection of a lead wire 170 to a terminal body 140 will be described. The lead wire 170 is inserted through lead wire receiving opening 180 and is positioned in the aperture 197 of clamp 190 between lead wire terminal 144 and clamp internal surface 199. With the wire 170 in position, the terminal screw 162 is rotated in its engaging direction. Since the screw head 166 abuts against shoulders 165, screw 162 cannot move forward. Instead, the engaging motion of screw 162 causes the clamp 190 to move in the direction of arrows C in FIG. 13. As the clamp 190 moves, the terminal 144 and the lead wire 170 are clamped between screw terminal surface 174 and clamp internal surface 199, thereby creating an electrical contact between terminal 144 and lead wire 170. Ridges 145 on lead wire terminal 140 help maintain wire 170 in position.

As can be seen in FIG. 9, rubber blocks 210 may be provided across the connector housing 102 to provide a moisture barrier between the lead wire terminal end 110 and the IDC terminal end 108.

What is claimed is:

1. An electrical connector comprising:

a housing having first and second ends and an internal cavity extending between them, the first end being open and the second end being generally closed to define a conductor passage, the second end further including a chamber which is aligned with and extends beyond the conductor passage;

a terminal member having a first end which is configured for interconnection with an insulation displacing contact and a middle portion which connects the first end with a second end that includes a generally planar electrical contact;

clamping means that includes a conductor receiving area and is positioned in the chamber with the conductor receiving area aligned with the conductor passage; and the terminal member is positioned in the housing with the first end thereof adjacent the first housing open end, the second end thereof positioned within the conductor receiving area and the middle portion thereof extending through the housing cavity, whereby a conductor is connected to the second end of the terminal member by passing it through the conductor passage and into the conductor receiving area whereupon actuation of the clamping means moves the planar electrical contact into contact with the conductor.

2. The connector of claim 1 wherein the planar electrical contact has a plurality of ridges on a first side thereof.

3. The connector of claim 1 further comprising a moisture barrier positioned in the internal cavity and separating the housing first and second ends.

4. The connector of claim 1 wherein the housing open end is dimensioned to receive an insulation displacement connector housing block.

5. The connector of claim 1 wherein the housing further includes top and bottom cover members.

6. The connector of claim 5 wherein one of the cover members includes a slot aligned with the terminal member first end.

7. The connector of claim 5 wherein the top and bottom members have a groove in which the terminal member middle portion is positioned.

8. The connector of claim 7 wherein the terminal member middle portion has at least one shoulder extending therefrom.

9. The connector of claim 5 wherein one of the cover members has a plurality of latches and the other has a plurality of tabs for interconnection of the cover members.

10. The connector of claim 5 wherein one of the cover members has a plurality of posts and the other has a plurality of receiving cavities for interconnection of the cover members.

11. The connector of claim 1 wherein the clamp means includes a clamp block having an aperture therethrough which defines the conductor receiving area.

12. The connector of claim 11 wherein the clamp means further includes a screw means which extends through a bore in the clamp block and terminates in an end surface within the aperture whereby actuation of the screw means moves the clamp block towards the end surface to bring the planar electrical contact into contact with the conductor.

13. The connector of claim 1 wherein the terminal member first end extends out of the first housing open end.

* * * * *